United States Patent [19]

Erdmann et al.

[11] Patent Number: 4,729,508

[45] Date of Patent: Mar. 8, 1988

[54] HINGED LID CONTAINER AND ONE-PIECE BLANK THEREFOR

[75] Inventors: Otto Erdmann, Hamburg; Reinhard Deutsch, Geesthacht; Harry David, Hamburg, all of Fed. Rep. of Germany

[73] Assignee: Körber AG, Hamburg, Fed. Rep. of Germany

[21] Appl. No.: 1,248

[22] Filed: Jan. 7, 1987

[30] Foreign Application Priority Data

Jan. 20, 1986 [DE] Fed. Rep. of Germany ..... 3601470

[51] Int. Cl.[4] ..... B65D 43/14

[52] U.S. Cl. ..... 229/146; 206/268; 206/273; 229/16 A; 229/DIG. 9; 229/160.1

[58] Field of Search ..... 229/16 A, 44 CB, DIG. 9, 229/146; 206/268, 273

[56] References Cited

U.S. PATENT DOCUMENTS

| | | | |
|---|---|---|---|
| 149,889 | 4/1874 | Smith | 229/44 CB |
| 2,367,717 | 1/1945 | Davidson | 229/DIG. 9 |
| 4,267,958 | 5/1981 | Focke et al. | 229/44 CB |

FOREIGN PATENT DOCUMENTS

| | | | |
|---|---|---|---|
| 2710163 | 9/1977 | Fed. Rep. of Germany | 229/44 CB |
| 2011353 | 7/1979 | United Kingdom | 229/44 CB |
| 2031380 | 4/1980 | United Kingdom | 229/44 CB |

*Primary Examiner*—Stephen Marcus
*Assistant Examiner*—Gary E. Elkins
*Attorney, Agent, or Firm*—Peter K. Kontler

[57] ABSTRACT

A hinged lid container for arrays of cigarettes is made of a one-piece blank and has a hollow body with an open end remote from its bottom wall, a collar which is integral with the front wall of the body at the open end and extends in part into the body, and a lid which is integral with the rear wall of the body. The collar has two lateral panels with rhomboidal portions extending beyond the respective sidewalls of the body. The free edges of the lateral panels are inclined with reference to the top wall of the lid when the latter is held in closed position so that its lateral walls abut the sidewalls of the body and are outwardly adjacent the rhomboidal portions of the lateral panels.

14 Claims, 2 Drawing Figures

HINGED LID CONTAINER AND ONE-PIECE BLANK THEREFOR

BACKGROUND OF THE INVENTION

The invention relates to improvements in so-called hinged lid containers of the type often employed for storage of arrayed cigarettes of other types of rod-shaped smokers' products. More particularly, the invention relates to improvements in hinged lid containers of the type wherein the lid is integral with and is pivotable relative to the rear wall of the hollow body of the container and a collar is inserted into the body so that a portion of the collar projects beyond the open end and is surrounded by the lid when the latter is held in closed position.

It is known to provide the sidewalls of the hollow body of a hinged lid container with edges which are inclined with reference to top wall of the lid when the latter is held in closed position. These edges abut the similarly inclined edges of the lateral walls of the lid. The exposed portions of lateral panels of the collar extend beyond the sloping edges of the sidewalls of the body and are parallel with the top wall of the lid when the latter is moved to its closed position. In other words, the sidewalls of the body and the exposed portions of the respective lateral panels of the collar together constitute two rectangular bodies each having a first short edge integral with the bottom wall of the body and a second short edge parallel to the top wall of the lid when the lid is held in closed position.

The making of hinged lid containers from blanks which are fed to and are converted in a modern high-speed cigarette packing machine necessitates the utilization of enormous quantities of sheet material from which the blanks are made. Even minor savings in such material (irrespective of whether the blanks are made from paper, cardboard or plastic) entail a very substantial reduction of the cost of packets of cigarettes or other types of products which are confined in hinged lid containers.

OBJECTS AND SUMMARY OF THE INVENTION

An object of the invention is to provide a hinged lid container which is at least as sturdy and at least as pleasing to the eye as heretofore known containers but which can be made from a much smaller quantity of sheet material.

Another object of the invention is to provide a hinged lid container with a novel and improved collar.

A further object of the invention is to provide the hinged lid container with novel and improved means for connecting its hollow body to the collar.

An additional object of the invention is to provide a novel and improved blank which can be converted into the above outlined hinged lid container.

A further object of the invention is to provide a novel and improved one-piece blank for conversion into a hinged lid container.

Still another object of the invention is to provide a novel and improved series of coherent blanks which can be made of a much smaller quantity of web or strip material than heretofore known blanks for conversion into hinged lid containers.

An additional object of the invention is to provide a novel and improved method of converting a one-piece blank into a hinged lid container of the above outlined character.

One feature of the present invention resides in the provision of a hinged lid container which comprises a hollow parallelepiped body having an open end and including a bottom wall opposite the open end, a planar rear wall between the bottom wall and the open end, a planar front wall between the open end and the bottom wall opposite the rear wall, and two confronting sidewalls which extend between the bottom wall and the open end and each of which is disposed between the front and rear walls. The container further comprises a collar which is integral with one of the walls (preferably with the front wall) and is disposed in part within the body and extends in part beyond the open end of the body. The collar has two lateral panels which extend from the body beyond the respective sidewalls, and the container further comprises a lid which is integral with the rear wall and has two lateral walls each of which is substantially coplanar with a different one of the sidewalls. The lid is pivotable relative to the body between a closed position in which its lateral walls abut the respective sidewalls and are outwardly adjacent the corresponding lateral panels of the collar, and an open position in which the open end of the body is exposed to afford access to the goods which are confined in the body. In accordance with a feature of the invention, the lateral panels of the collar have elongated edges which are remote from the sidewalls of the body, which make acute angles with the plane of the rear wall of the body, and which make obtuse angles with the plane of the front wall of the body.

Those edges of the sidewalls of the body which are adjacent the open end of the body are preferably parallel to the edges of the respective lateral panels of the collar.

The body preferably comprises a narrow elongated web which is integral with the collar and is flanked by two elongated fold lines. One of these fold lines is disposed between the web and the collar and is more distant from the open end of the body than the other fold line as a result of so-called Z-folding of the web relative to the adjacent portions of the front wall of the body and the front panel of the collar.

The lateral panels of the collar preferably have rhomboidal portions which are outwardly adjacent the edges of the respective sidewalls. The edges of the lateral panels of the collar are, or can be, straight and are inclined with reference to the top wall of the lid when the latter is held in closed position.

Another feature of the invention resides in the provision of an elongated one-piece blank of paper, lightweight cardboard or a plastic sheet material which can be converted into the aforementioned hinged lid container, i.e., into a container having a hollow body, a collar and a lid. The blank has two elongated parallel marginal portions and comprises an elongated main section which is convertible into the body of the container, a second section which is convertible into the lid of the container and is disposed at one end of the elongated main section, and a third section which is convertible into the collar of the container and is disposed at the other end of the elongated main section. The blank further comprises first and second elongated fold lines which are parallel with and are respectively adjacent the first and second marginal portions, and the third section has mutually inclined first and second free edges one of which extends between the first marginal portion and the first fold line and the other of which extends between the second marginal portion and the second fold line. The free edges slope toward the main section in directions from the respective marginal portions toward the respective fold lines.

The blank is further formed with first and second slits which are adjacent and substantially parallel to the first and second free edges and are disposed between the main section and the third section of the blank. The free edges constitute the exposed edges of the lateral panels of the collar in the assembled container, and those edges of the main section which are adjacent the slits constitute the edges of the sidewalls of the body when the main section of the blank is converted. The third section has a first rhomboidal flap between the first edge and the first slit, and a second rhomboidal flap between the second edge and the second slit. These flaps constitute the lateral panels of the collar, i.e., of the converted third section of the blank.

The main section includes a narrow elongated web which extends transversely of the marginal portions between the first and second fold lines and integrally connects the main section with the third section of the blank. Such web is flanked by two additional fold lines which extend transversely of the marginal portions of the blank between the first and second fold lines.

The second section of the blank has first and second edges which are respectively parallel to the first and second edges of the third section of the blank. The first and second edges of the third section preferably form part of a first composite free edge which is provided at the respective end of the blank and is complementary to a second composite free edge which is provided on the second section at the other end of the blank.

The novel features which are considered as characteristic of the invention are set forth in particular in the appended claims. The improved container itself, however, both as to its construction and the mode of making the same from a one-piece blank, together with additional features and advantages thereof, will be best understood upon perusal of the following detailed description of certain specific embodiments with reference to the accompanying drawing.

DESCRIPTION OF THE PREFERRED EMBODIMENTS

Figure 1:
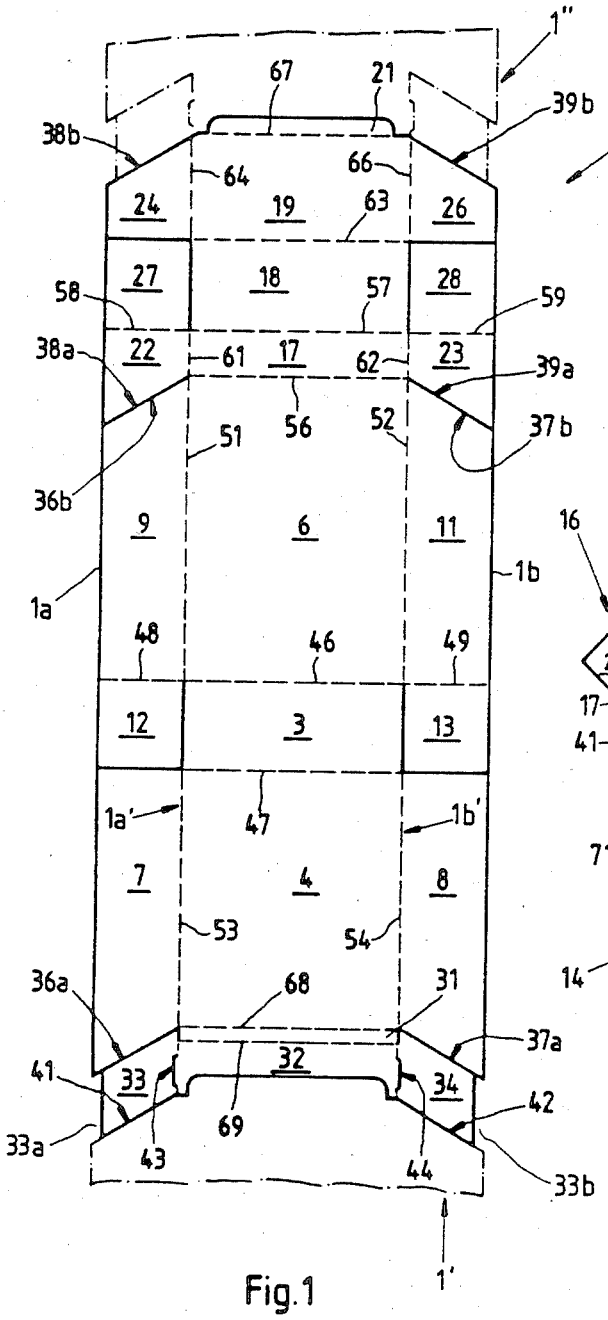
FIG. 1 is a plan view of a blank which is made in accordance with the invention and can be converted into the improved hinged lid container.
Figure 2:
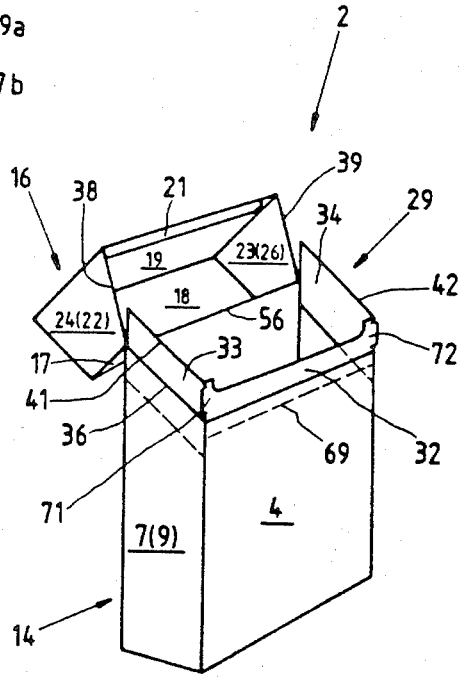
FIG. 2 is a perspective view of the assembled container, with the hinged lid shown in open position.

FIG. 1 shows an elongated one-piece narrow blank 1 which can be converted into a hinged lid container 2 of the type shown in FIG. 2. Those portions of the blank 1 which are shown by solid lines constitute the outlines or slits and the portions which are shown by broken lines indicate fold lines.

The blank 1 includes an elongated main portion which is convertible into a hollow open-ended body 14 of the container 2, a second section which is disposed at one end of the main section and is convertible into a pivotable lid 16 of the container 2, and a third section which is disposed at the other end of the main section and is convertible into a substantially U-shaped collar 29 of the container 2. The third section includes the parts 32, 33 and 34 of the blank 1, the second section includes the parts 17, 18, 19, 21, 22, 23, 24, 26, 27 and 28 of the blank 1, and the main section includes the remaining parts of the blank. The latter comprises two elongated parallel marginal portions 1*a*, 1*b* and two elongated composite fold lines 1*a*′, 1*b*′ which are parallel to and are respectively adjacent the marginal portions 1*a* and 1*b*. The composite fold line 1*a*′ includes discrete fold lines 51, 53, 61, 64 and the composite fold line 1*b*′ includes discrete fold lines 52, 54, 62, 66. The blank 1 which is shown in FIG. 1 in its entirety is disposed between two additional blanks 1′ and 1″ portions of which are shown by phantom lines. All of the blanks form part of an elongated web or strip of paper, plastic or lightweight cardboard, depending upon the desired appearance, sturdiness, cost and/or other parameters of the containers which are made from the blanks.

The main section of the blank 1 comprises a planar rectangular panel 3 which constitutes the bottom wall of the body 14 of the container 2, a planar rectangular panel 4 which constitutes the front wall of the body 14, a planar rectangular panel 6 which constitutes the rear wall of the body 14, two lateral panels 7, 8 which flank the panel 4 and constitute the outer portions of composite sidewalls of the body 14, two lateral panels 9, 11 which flank the panel 6 and constitute the inner portions of the composite sidewalls of the body 14, and two square flaps 12, 13 which overlie the inner side of the bottom wall 3 in the body 14. The panels 4, 6 are integral with the long edges of the panel 3, and the flaps 12, 13 are integral with the short edges of the panel 3. The flaps 12 and 13 are respectively integral with the panels 9 and 11. The main section of the blank 1 further comprises a narrow elongated web 31 which is integral with the front panel 32 of the third section 32–34 (convertible into the collar 29) and extends between the fold lines 1*a*′, 1*b*′ at right angles to the marginal portions 1*a*, 1*b*.

The second section of the blank 1 comprises a narrow panel 17 which is integral with the panel 6 and constitutes the rear wall of the lid 16, a panel 18 which is integral with the panel 17 and constitutes the top wall of the lid 16, an elongated panel 19 which is integral with the panel 18 and constitutes the front wall of the lid 16, an elongated flap 21 which is integral with the panel 19 opposite the panel 18 and is to be folded over the inner side of the panel 19, two generally trapeziform flaps 22, 23 which are integral with the short edges of the panel 17 and constitute the inner portions of lateral walls of the lid 16, two generally trapeziform flaps 24, 26 which are integral with the short edges of the panel 19 and constitute the outer portions of lateral walls of the lid 16, and two square flaps 27, 28 which are respectively integral with the flaps 24, 26 and are adjacent the inner side of the top wall 18 of the lid 16. The length of each edge of each of the flaps 27, 28 equals or approximates the length of a shorter edge of the panel 18.

The third section of the blank 1 comprises the aforementioned panel 32 which is convertible into the front panel of the collar 29 and two additional panels in the form of rhomboidal flaps 33, 34 which flank the panel 32 adjacent the blank 1′ and constitute the lateral panels of the collar 29. The panel 32 is integral with the narrow web 31 and the panels 33, 34 have outer edges 41, 42 which are adjacent to slits between the blanks 1 and 1′. The edges 41 and 42 slope toward the main section of the blank 1 in directions from the respective marginal portions 1*a*, 1*b* toward the respective composite fold lines 1*a*′, 1*b*′. The edges 41, 42 are respectively parallel to slits between the panels 7, 33 and 8, 34, and those edges of the panels 7, 8 which are adjacent such slits are respectively denoted by the characters 36*a* and 37*a*. The edges 36*a*, 37*a* are the free edges of the outer panels 7, 9 of the composite lateral walls 7, 9 and 8, 11 of the open-ended body 14 of the assembled container 2. One such edge is shown in FIG. 2, as at 36. The edges 41, 42 and 36 make acute angles with the plane of the rear wall 6 and obtuse angles with the plane of the front wall 4 of the body 14.

FIG. 1 further shows that the slits between the panels 9, 11 on the one hand and the flaps 22, 23 on the other hand are bounded by sloping edges 36*a*, 36*b* of the panels 9, 11 and by similarly sloping edges 38*b*, 39*b* of the flaps 22, 23. When the main section of the blank 1 is converted into the body 14 of the container 2, the edges 36*b*, 36*b* respectively register with the edges 36*a*, 37*a* of the panels 7, 8 and the edges 38*a*, 39*a* respectively register with the edges 38*b*, 39*b* whose inclination is the same as that of the edges 41, 42 respectively.

It will be seen that, when a length (1) of the strip which includes the blanks 1", 1, 1' is converted into a container 2, practically the entire blank 1 is used up all the way between the marginal portions 1*a*, 1*b* with the sole exception of two minor portions 33*a*, 34*a* outwardly adjacent the panels or flaps 33, 34 of the third section which is thereupon converted into the collar 29. All in all, only approximately 0.3 percent of the web portion between the edges 38*b*, 39*b* and 41, 42 goes to waste.

The manner of converting the blank 1 into the container 2 is as follows: The blank 1 is separated from the blank 1' along the composite edge including the mutually inclined edges 41, 42 and the edge adjacent the panel 32 of the third section, and such blank is further separated from the blank 1" along the composite edge including the mutually inclined edges 38*b*, 39*b* and the edge adjacent the flap 21 of the second section. The slits along the edges 38*b*, 39*b* are bounded at one side by the edges 41, 42 of the third section of the blank 1".

The panels 4, 6 of the blank 1 are pivoted at right angles along fold lines 47, 46 to constitute the front and rear walls of the body 14, the panels 9, 11 are pivoted at right angles along fold lines 51, 52 to form the inner portions of sidewalls of the body 14, and the panels 7, 8 are pivoted at right angles along fold lines 53, 54 to overlie the panels 9, 11 and to form therewith composite sidewalls 7, 9 and 8, 11 of the body 14. One side of each of the panels 7, 8 and/or the other side of each of the panels 9, 11 is coated with a suitable adhesive to ensure that the panels 7, 8 respectively adhere to the panels 9, 11. The flaps 12, 13 are pivoted at right angles along the fold lines 48, 49 prior to pivoting of the panel 6 along the fold line 46 so that these flaps overlie the inner side of the bottom wall 3 of the finished body 14.

The lid 16 is formed by pivoting the flap 21 through 180 degrees along the fold line 67 so that it overlies the inner side of the adjacent portion of the panel 19. The flaps 22, 23 are pivoted through 90 degrees along fold lines 61, 62 at right angles to the panel 17 and the flaps 27, 28 are pivoted to positions at right angles to the flaps 22, 23 (note the fold lines 58, 59) so that they overlie the inner side of the panel 18 when the latter is converted into the top wall of the lid 16. The flaps 24, 26 are pivoted through 90 degrees along fold lines 64, 66 to overlie the flaps 22, 23 and to form therewith composite lateral walls of the lid 16 after the panel 18 is pivoted relative to the panel 17 through 90 degrees along the fold line 57 and the panel 19 is pivoted relative to the panel 18 through 90 degrees along the fold line 63. The flaps 22, 23 are bonded to the inner sides of the flaps 24, 26 by a suitable adhesive, and the flap 67 is also bonded to the inner side of the panel 19. The fold line 56 determines the locus of pivotal connection between the rear wall 6 of the body 14 and the rear wall 17 of the lid 16. The thickness of composite lateral walls 22, 24 and 23, 26 of the lid 16 matches or approximates the thickness of composite sidewalls 7, 9 and 8, 11 of the body 14. When the lid 16 is pivoted to its closed position, the sloping edges 38, 39 of its lateral walls 22, 24 and 23, 26 respectively abut the sloping edges 36 of the composite sidewalls 7, 9 and 8, 11. The container 2 then resembles a hollow brick.

The web 31 is pivoted relative to the front wall 4 of the body 14 along the fold line 68 in one direction, and the panel 32 of the third section is then pivoted relative to the web 31 along the fold line 69 in the opposite direction so that the web 31 and the adjacent portions of the wall 4 and panel 32 together form a so-called Z-fold which ensures that a portion of the panel 32 extends into the interior of the body 14 along the open end of the latter and the remaining major portion of the panel 32 extends outwardly beyond the front wall 4 and constitute the front panel of the collar 29. The fold line 69 is then more distant from the open end of the body 14 than the fold line 68.

The fold lines along the shorter edges of the panel 32 are formed with slits 43, 44 of finite length which are offset relative to the major portions of the respective fold lines 1*a*', 1*b*' so that the lateral portions of the panel 32 form two elongated but narrow lugs 71, 72 in response to pivoting of the flaps 33, 34 to positions at right angles to the plane of the panel 32. These flaps then constitute the lateral panels of the collar 29 and each thereof has a relatively narrow portion in the interior of the body 14 and a larger rhomboidal portion which extends beyond the edge 36 of the respective sidewall 7, 9 or 8, 11 and is inwardly adjacent the respective lateral wall 22, 24 or 23, 26 of the lid 16 when the latter is pivoted to closed position. The edges 41, 42 of exposed rhomboidal portions of the lateral walls 33, 34 of the collar 29 are parallel to the edges 36 of the respective sidewalls of the body 14. The edges 41, 42 are further parallel to the edges 38, 39 of the lateral walls 22, 24 and 23, 26 of the lid 16 when the latter is held in the closed position. Those portions of the lateral walls 33, 34 which are confined in the body 14 are bonded to the inner sides of inner panels 9, 11 of the respective sidewalls of the body 14.

The lugs 71, 72 bear against the inner sides of the respective lateral walls 22, 24 and 23, 26 to prevent accidental opening of the container 2 and spilling of its contents. Thus, the user of the container 2 must overcome a certain frictional resistance in order to pivot the lid 16 to the open or to the closed position.

When the lid 16 is closed, the edges 41, 42 of the lateral panels 33, 34 of the collar 29 are inclined with reference to the inner side of the top wall 18 due to the aforediscussed inclination of the edges 41, 42 relative to the marginal portions 1*a* and 1*b* of the blank 1 prior to conversion of the blank into the container 2. It has been found that the aforediscussed rhomboidal configuration of the exposed portions of lateral panels 33, 36 of the collar 29 does not detract from the appearance and/or stability of the container 2 and does not adversely affect the ability of the container to properly confine an array of cigarettes or the like. It will be seen that the configuration of the composite sidewall including the panels 7, 9 and the panel 33 deviates from a truly rectangular shape due to the aforediscussed inclination of the edge 41, and the same holds true for the configuration of the composite sidewall including the panels 8, 11 and the lateral panel 34.

FIG. 1 shows that the neighboring blanks 1'', 1, 1' are immediately adjacent each other so that no material is wasted as a result of separation of the blank 1' from the blank 1 or as a result of separation of the blank 1 from the blank 1''. In fact, each of the blanks 1, 1', 1'' is considerably shorter than a conventional blank which is to be converted into a conventional hinged lid container having the dimensions of the container 2. The narrowness of the web 31 between the main section and the third section of each blank also contributes to a reduction of overall length of the respective blank.

The quantity of sheet material which is needed to make the improved container is approximately 87 percent of the quantity of material which is needed to make a container of identical size from a conventional blank. As mentioned above, only approximately 0.3 percent of the material of a strip which is converted into a blank 1, 1' or 1'' goes to waste. The resultant savings in sheet material are enormous in a modern cigarette packing machine which can turn out several hundred cigarette packs per minute. As mentioned above, such savings in sheet material can be achieved without in any way affecting the appearance, stability and/or other qualities of the container, such as the ability of the container to maintain its lid in closed position.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A hinged lid container comprising a hollow parallelpiped body having an open end and including a bottom wall, a planar rear wall, a planar front wall and two sidewalls; a collar integral with one of said walls and disposed in part within and extending in part beyond the open end of said body, said collar having two elongated panels extending from said body beyond said sidewalls; and a lid integral with said rear wall and having two lateral walls each substantially coplanar with a different one of said sidewalls, said lid being pivotable relative to said body between a closed position in which said lateral walls abut the respective sidewalls and are outwardly adjacent the corresponding lateral panels and an open position in which said open end is accessible, each of said lateral panels having a single elongated edge remote from the respective sidewall, making an acute angle with the plane of said rear wall and making an obtuse angle with the plane of said front wall, thereby sloping upwardly from front to rear of the container.

2. The container of claim 1, wherein said sidewalls have edges which are at least substantially parallel to the edges of said lateral panels.

3. The container of claim 2, wherein said body comprises a narrow elongated web which is integral with said collar.

4. The container of claim 3, wherein said body has two elongated fold lines flanking said web, one of said fold lines being disposed between said web and said collar and being more distant from said open end than the other of said fold lines.

5. The container of claim 2, wherein said collar is integral with said front wall at the open end of said body.

6. The container of claim 2, wherein the lateral panels of said collar have rhomboidal portions outwardly adjacent the edges of the respective sidewalls.

7. The container of claim 1, wherein said lid has a top wall and the edges of said lateral panels are inclined relative to said top wall in the closed position of said lid.

8. An elongated one-piece blank for conversion into a hinged lid container having a hollow body, a collar and a lid, said blank having two elongated parallel marginal portions and comprising an elongated main section convertible into the body of the container, a second section convertible into the lid and disposed at one end of said main section, and a third section convertible into the collar and disposed at the other end of said main section, said blank further having first and second elongated fold lines parallel with and respectively adjacent said first and second marginal portions, said third section having mutually inclined first and second edges one of which extends all the way between said first marginal portion and said first fold line and the other of which extends all the way between said second marginal portion and said second fold line, said edges being formed at one end of the blank, said edges making acute angles with the respective marginal portions and sloping toward said main section in directions from the respective marginal portions toward the respective fold lines.

9. The blank of claim 8, further having first and second slits which are adjacent and substantially parallel to said first and second edges and are disposed between said main section and said third section.

10. The blank of claim 9, wherein said third section has a first rhomboidal flap between said first edge and said first slit and a second rhomboidal flap between said second edge and said second slit.

11. The blank of claim 8, wherein said main section includes a narrow elongated web extending transversely of said marginal portions between said fold lines and integrally connecting said main section with said third section.

12. The blank of claim 11, further comprising two additional fold lines flanking said web and extending transversely of said marginal portions between said first and second fold lines.

13. The blank of claim 8, wherein said second section has first and second edges which are respectively parallel to the first and second edges of said third section.

14. The blank of claim 8, wherein said third section has a first composite free edge including said first and second edges and extending between said marginal portions at one end of the blank, said second section having a second composite free edge extending between said marginal portions and complementary to said first free edge.

* * * * *